US005184801A

United States Patent [19]

Finkelstein

[11] Patent Number: 5,184,801

[45] Date of Patent: Feb. 9, 1993

[54] WINGED FENCE SLAT CONSTRUCTION

[75] Inventor: Harvey Finkelstein, Washington Township, Bergen County, N.J.

[73] Assignee: Tri-Seal International, Inc., Blauvelt, N.Y.

[21] Appl. No.: 894,577

[22] Filed: Jun. 5, 1992

[51] Int. Cl.[5] ..... B21F 2/700

[52] U.S. Cl. ..... 256/34; 256/32; 245/11

[58] Field of Search ..... 256/34, 32; 245/11

[56] References Cited

U.S. PATENT DOCUMENTS

| | | | |
|---|---|---|---|
| 4,512,556 | 4/1985 | Meglino | 256/34 |
| 4,860,997 | 8/1989 | Schoenheit et al. | 256/34 |
| 4,860,998 | 8/1989 | Snyder | 256/34 |
| 5,007,619 | 4/1991 | Sibeni | 256/34 |
| 5,106,058 | 4/1992 | Finkelstein | 256/34 |

*Primary Examiner*—Andrew V. Kundrat
*Attorney, Agent, or Firm*—Frank P. Presta

[57] ABSTRACT

Slat apparatus for use with a chain link fence for providing privacy, wind protection and/or decoration, including a plurality of slat members for positioning in slat receiving channels formed by the linking wires of the fence such that substantially no space remains between adjacent slats. Each slat member includes a substantially rigid elongated body member and a pair of flexible and resilient wing portions positioned on opposite sides thereof. The combined width of the wing portions is approximately equal to or greater than the width of the body member to enable easy installation of the slats and to provide complete privacy in a neat and uniform manner. The slat apparatus preferably is formed by co-extrusion of a substantially rigid plastic material for the body member and a flexible and resilient plastic material for the wing portions.

14 Claims, 2 Drawing Sheets

FIG. 1
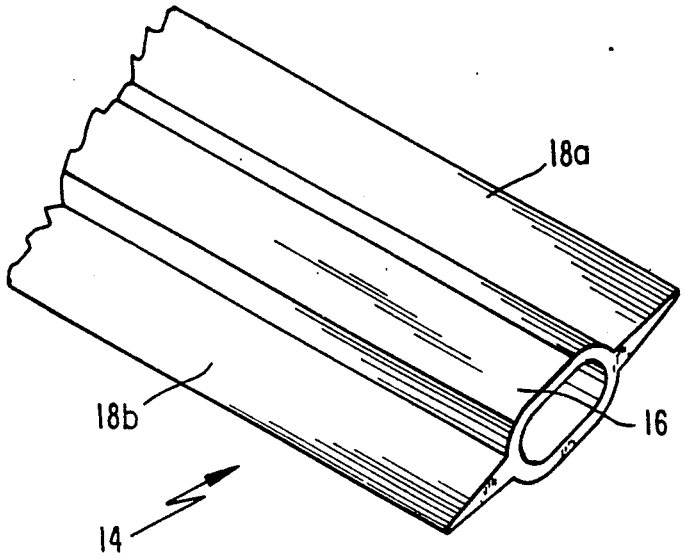
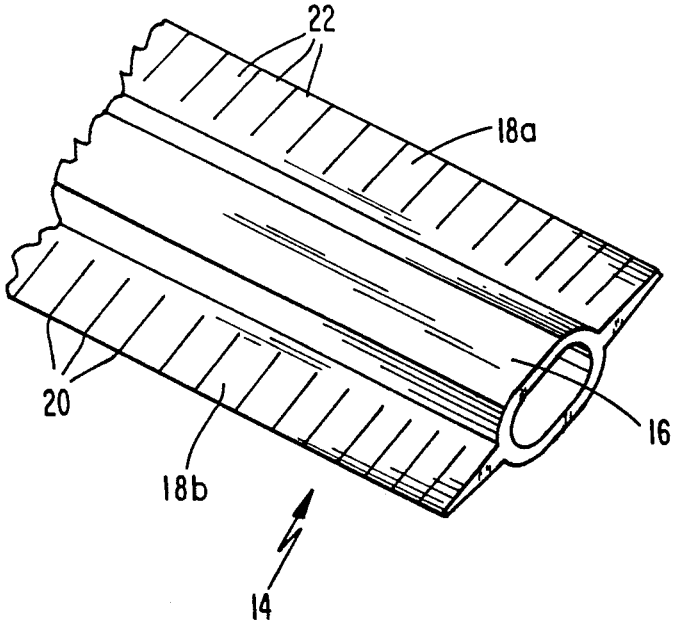
FIG. 2

WINGED FENCE SLAT CONSTRUCTION

BACKGROUND OF THE INVENTION

The present invention relates to a slat construction for chain link fences or the like and, more particularly, to such a construction wherein the slats are provided with wing portions which flex around the knuckles formed by the linking wires of the fence so that substantially no space remains between adjacent slats, thereby providing increased privacy, wind protection and/or decorative effect.

Various slat constructions for insertion in receiving channels formed in the fence by the fence linking wires have been provided in the past as evidenced by the patents to Meglino No. U.S. Pat. No. 4,512,556, Sibeni No. U.S. Pat. No. 5,007,619 and Snyder No. U.S. Pat. No. 4,860,998. The patent to Meglino discloses fence slats which include a thick body portion having a width which is approximately equal to the width of the receiving channels. This type of slat construction has a disadvantage in that it does not enable the slats to be in close relation to adjacent slats, thereby not providing adequate privacy.

The patent to Sibeni discloses a slat construction which reduces the size of the gaps between adjacent slats by providing thin wing or fin portions on the sides of the slat. The wing portions enable the slats to be made slightly wider than the type disclosed in the Meglino patent because the thin wing portions are able to extend partially into the knuckles of the fence. This type of slat construction slightly reduces but does not eliminate the problem of gaps remaining between adjacent slats. In addition, due to the fact that the wing portions are rigid and must wedge between the wires forming the knuckles, installation of the slats is difficult and time consuming.

The patent to Snyder discloses a slat construction which includes a body portion having a width which is approximately equal to the width of the fence receiving channel and small fringe portions which hug the knuckles of the fence and extend beyond the receiving channel to minimize the space between adjacent slats. The fringe portions are made up of a plurality of transversely extending, flexible, substantially position maintaining strands. Due to the fact that the width of the body member is large relative to the width of the fringe portions, it is difficult for the fringe portions to have enough flexibility to flex around the knuckles and thus often do not provide complete privacy. Installation of this type of slat construction is difficult and often requires the use a special insertion tool. In addition, in order for the fringe portions to flex around the knuckles, the width of the individual fringe portion strands must be very small, i.e., approximately onesixteenth of an inch. This type of slat construction does not enable the slat to provide privacy in a neat and uniform fashion. The small individual strands often do not maintain the desired position over an extended period of time resulting in an unattractive frayed appearance and a decreased level of privacy.

The new and improved slat construction of the present invention overcomes the disadvantages of other fence slat constructions hereinbefore described by providing a fence slat which is easy to install and provides the desired privacy in a neat and uniform fashion.

SUMMARY OF THE INVENTION

Accordingly, it is a primary object of the present invention to provide a slat apparatus for use with a fence of the type having linking wires which form knuckles and define a plurality of slat receiving channels therebetween, comprising a plurality of slat members each including an elongated body member and a pair of flexible wing portions positioned on opposite sides thereof and being of substantially the same width, wherein the combined width of the wing portions is approximately equal to or greater than the width of the body member.

A more particular object of the present invention is to provide a slat apparatus wherein the body member has a width which is approximately equal to half the width of the slat receiving channel and further wherein the body member is made of a substantially rigid material and the wing portions are made of a flexible and resilient material.

A further object of the present invention is to provide transverse cuts in the wing portions of the slats to form a plurality of substantially position maintaining wing members and increase the flexibility thereof.

DESCRIPTION OF THE DRAWING

Other objects and advantages of the subject invention will become apparent from a study of the following specification when viewed in light of the accompanying drawing, in which:

FIG. 1 is a perspective view of one embodiment of the slat apparatus of the present invention.

FIG. 2 is a perspective view of an alternative embodiment of the slat apparatus of the present invention.

DETAILED DESCRIPTION

Figure 3:
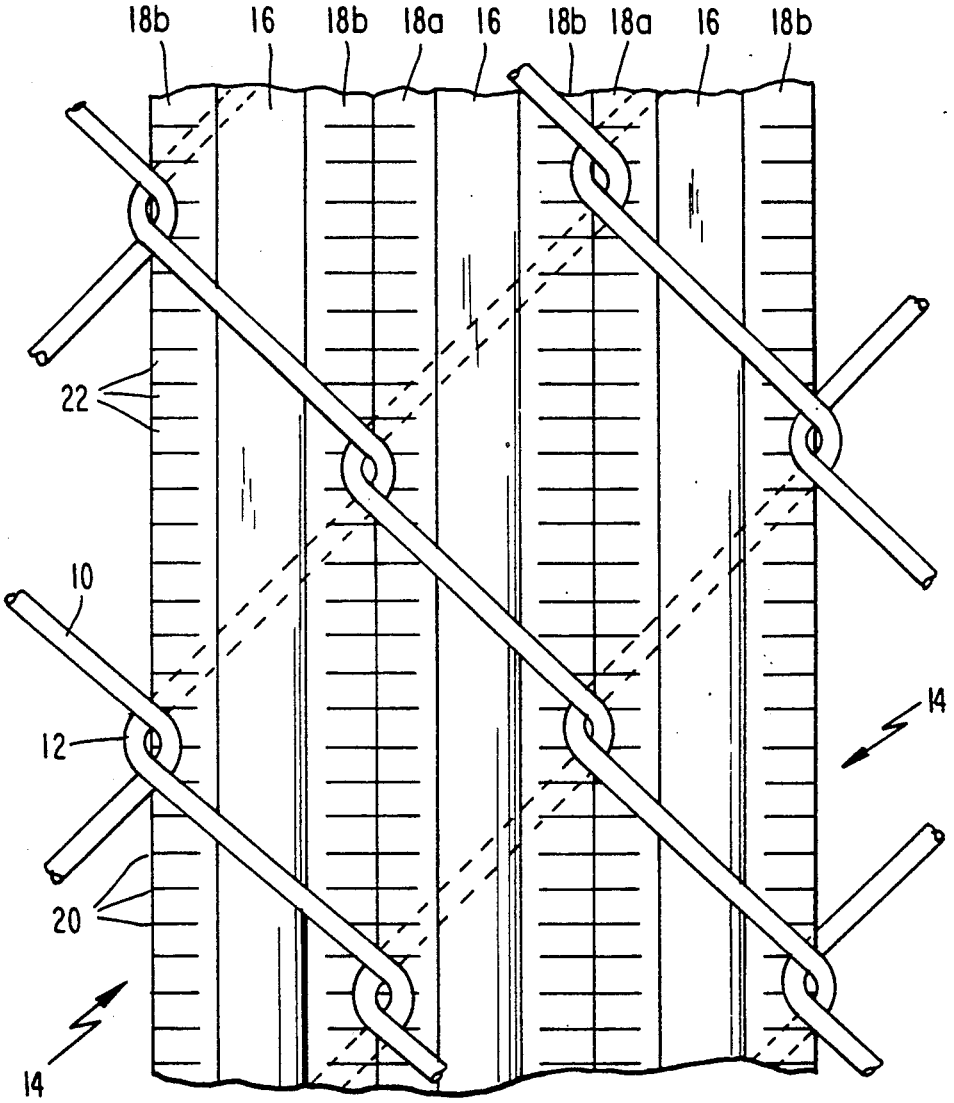
FIG. 3 is a front elevational view of a portion of a chain link fence with the slat apparatus of FIG. 2 inserted therein.

Referring now to FIGS. 1 through 3 there is shown the slat apparatus of the present invention. The slat apparatus is constructed for use with a fence having linking wires 10 which form knuckles 12 and define a plurality of slat receiving channels therebetween. The slat apparatus includes a plurality of slat members 14 for positioning in the slat receiving channels of a fence. Each of the slat members 14 includes an elongated body member 16 and a pair of wing portions 18*a* and 18*b* of substantially the same width positioned on opposite sides of the body member 16.

In order to enable the slat members 14 to be easily installed in the fence and leave substantially no spaces between adjacent slat members, the combined width of the wing portions 18*a* and 18*b* is approximately equal to or greater than the width of the body member 16. This ratio of body member width to wing portion width enables the slat apparatus to provide the desired privacy in a neat and uniform fashion not heretofore achieved. The width of the body member 16 will depend on the width of the receiving channels in the fence in which the slat members 14 are to be installed. The width of the body member 16 preferably is approximately equal to half the width of the respective receiving channel. As an illustrative example for a common chain link fence, the body member 16 may have a width of approximately three-quarters of an inch and the wing portions 18*a* and 18*b* may each have a width of approximately one-half of an inch.

The body member 16 may be made of any suitable material, but preferably a substantially rigid plastic material such as high density polyethylene or other suitable plastic material should be used. The wing portions 18*a* and 18*b* are relatively thin and tapered outwardly and inwardly from the body member 16 and may be made of any suitable material which is flexible and resilient so as to enable the wing portions 18*a* and 18*b* to flex around the knuckles 12 and extend beyond the slat receiving channel such that substantially no space remains between adjacent slat members. Preferably, the wing portions 18*a* and 18*b* are made of a suitable plastic material such as a mixture of polyethylene and ethyl vinyl acetate, the percentage of ethyl vinyl acetate being approximately 3%-22% by weight depending on the flexibility desired. Preferably, the body member 16 and wing portions 18*a* and 18*b* are made by co-extrusion of the respective materials used. By co-extruding the slat member 14, a strong bond is achieved between the body member 16 and the wing portions 18*a* and 18*b*, thereby providing a slat member 14 which does not separate or become damaged during installation. The body member 16 preferably is hollow and the wing portions 18*a* and 18*b* preferably are solid.

In order to provide additional flexibility and better enable the wing portions to bend around the fence knuckles, the wing portions 18*a* and 18*b* may be provided with transverse cuts 20 therein, as shown in FIGS. 2 and 3. The cuts 20 define a plurality of substantially position maintaining wing members 22. Preferably, the cuts 20 are provided along the wing portions 18*a* and 18*b* approximately every one-quarter of an inch, thereby forming wing members 22 which are approximately onequarter of an inch in height. The cuts 20 may extend partially or fully through the width of the wing portions 18*a* and 18*b*. However, by providing the cuts 20 only partially through the width of the wing portions 18*a* and 18*b*, the individual wing members 22 will tend to maintain a desired straight and substantially uniform position. Due to the above-described width ratio between the body member 16 and the wing portions 18*a* and 18*b*, the cuts 20 can be spaced farther apart than prior slat constructions and still provide easy installation and uniform appearance of the wing members 22.

The invention as herein described provides a new and improved slat apparatus for use with a chain link fence which is easy to install and provides complete privacy in a neat and uniform fashion not heretofore achieved.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. Slat apparatus for use with a fence of the type having linking wires which form knuckles and define a plurality of slat receiving channels therebetween, comprising a plurality of slat members for positioning in said slat receiving channels, respectively, each of said slat members including an elongated body member and a pair of flexible and resilient wing portions of substantially the same width positioned on opposite sides of said body member, wherein the combined width of said wing portions is at least approximately equal to the width of said body member, and the outer ends of said wing portions are sufficiently thin so as to enable said wing portions to flex around the fence knuckles and extend beyond said slat receiving channels such that substantially no space remains between the wing portions of adjacent slat members when positioned in the slat receiving channels of the fence.

2. Apparatus as defined in claim 1, wherein the width of said body member is approximately half the width of a slat receiving channel.

3. Apparatus as defined in claim 1, wherein said wing portions have substantially transverse cuts therein defining a plurality of substantially position maintaining wing members to increase the flexibility of said wing portions.

4. Apparatus as defined in claim 1 wherein the combined width of said wing portions is greater than the width of said body member.

5. Apparatus as defined in claim 1, wherein said body member is made of a substantially rigid material.

6. Apparatus as defined in claim 5, wherein said body member and said wing portions are integrally formed of plastic materials.

7. Apparatus as defined in claim 6, wherein said body member and said wing portions are co-extruded from different plastic materials.

8. Apparatus as defined in claim 5, wherein said body member is made of high density polyethylene.

9. Apparatus as defined in claim 5, wherein said wing portions are made of a mixture of polyethylene and ethyl vinyl acetate.

10. Apparatus as defined in claim 1, wherein said body member is approximately three-quarters of an inch in width.

11. Apparatus as defined in claim 10, wherein said wing portions are each approximately one-half of an inch in width.

12. Apparatus as defined in claim 3, wherein said transverse cuts are provided approximately every one-quarter of an inch along the length of said wing portions.

13. Apparatus as defined in claim 3, wherein said transverse cuts extend only partially through the width of said wing portions.

14. Apparatus as defined in claim 1, wherein said body member is hollow.

* * * * *